US010050370B2

(12) United States Patent
Kashiwada

(10) Patent No.: US 10,050,370 B2
(45) Date of Patent: Aug. 14, 2018

(54) RUBBER PLUG FIXED BY A PLUG HOLDER TO A COVER FIXED TO A DEVICE

(71) Applicant: Sumitomo Wiring Systems, Ltd., Yokkaichi, Mie (JP)

(72) Inventor: Tomokazu Kashiwada, Mie (JP)

(73) Assignee: Sumitomo Wiring Sytems, Ltd. (JP)

( * ) Notice: Subject to any disclaimer, the term of this patent is extended or adjusted under 35 U.S.C. 154(b) by 0 days.

(21) Appl. No.: 15/572,552

(22) PCT Filed: May 23, 2016

(86) PCT No.: PCT/JP2016/065120

§ 371 (c)(1),
(2) Date: Nov. 8, 2017

(87) PCT Pub. No.: WO2016/190265

PCT Pub. Date: Dec. 1, 2016

(65) Prior Publication Data

US 2018/0159263 A1 Jun. 7, 2018

(30) Foreign Application Priority Data

May 28, 2015 (JP) ..... 2015-108322

(51) Int. Cl.
*H01R 13/40* (2006.01)
*H01R 13/443* (2006.01)
*H01R 13/508* (2006.01)

(52) U.S. Cl.
CPC ..... *H01R 13/443* (2013.01); *H01R 13/508* (2013.01)

(58) Field of Classification Search
CPC ..... H01R 13/44; H01R 13/5202; H01R 13/5205; H01R 13/521; H01R 13/5213
(Continued)

(56) References Cited

U.S. PATENT DOCUMENTS 4,810,208 A * 3/1989 Hayes ..... H01R 13/5208 439/281
5,551,892 A 9/1996 Endo et al.
(Continued)

FOREIGN PATENT DOCUMENTS

| | | |
|---|---|---|
| JP | 7-122331 | 5/1995 |
| JP | 2015-082465 | 4/2015 |
| WO | 2014/069285 | 5/2014 |

OTHER PUBLICATIONS

International Search Report dated Aug. 9, 2016.

*Primary Examiner* — Chandrika Prasad
(74) *Attorney, Agent, or Firm* — Gerald E. Hespos; Michael J. Porco; Matthew T. Hespos

(57) ABSTRACT

A cover unit (50) includes a plug holder (60) mounted on a cover (51). A rubber plug (80) is attached to the plug holder (60) and closes an opening (30) of a device (C). The rubber plug (80) includes a cylindrical body (81) to fit in the opening (30). A mounting tongue (87) extending from a base of the body (81) via a coupling (85) and has a locking hole (89). The plug holder (60) includes an insertion hole (75) allowing the mounting tongue (87) of the rubber plug (80) to be inserted on a side opposite to the plug body (81). A hook (67) engages the locking hole (89) of the mounting tongue (87) inserted into the insertion hole (75). The mounting tongue (87) of the rubber plug (80) is thicker than the coupling (85).

6 Claims, 23 Drawing Sheets

(58) Field of Classification Search
USPC ..... 439/587, 588, 589, 272, 274, 275
See application file for complete search history.

(56) References Cited

U.S. PATENT DOCUMENTS

| | | | | |
|---|---|---|---|---|
| 6,371,807 | B1 * | 4/2002 | Takagishi | H01R 13/5221 439/587 |
| 6,485,332 | B1 * | 11/2002 | Kwang | H01R 13/443 439/587 |
| 7,048,580 | B2 * | 5/2006 | Kobayashi | H01R 13/5221 439/587 |
| 8,241,061 | B2 * | 8/2012 | Chazottes | H01R 13/5213 439/272 |
| 9,203,178 | B2 * | 12/2015 | Sakakura | H01R 13/5213 |
| 2007/0141904 | A1 * | 6/2007 | Hayashi | H01R 13/5208 439/587 |
| 2008/0139029 | A1 * | 6/2008 | Tsuji | H01R 13/4364 439/271 |
| 2014/0377970 | A1 * | 12/2014 | Crovetti | H01R 13/5213 439/131 |
| 2015/0029067 | A1 | 1/2015 | Pang et al. | |
| 2016/0315415 | A1 * | 10/2016 | Kataoka | H01R 13/5205 |
| 2017/0069997 | A1 * | 3/2017 | Markefka | B60D 1/64 |

* cited by examiner

RUBBER PLUG FIXED BY A PLUG HOLDER TO A COVER FIXED TO A DEVICE

BACKGROUND

Field of the Invention

This specification relates to a connector including a cover unit with rubber plug for covering an opening of an electrical device and a voltage detection opening.

Description of the Related Art

A known power supply circuit is formed by connecting a connector provided on a wire end on a power supply side to a connector disposed on a device side to supply power to a device. The power supply circuit is cut off by operating a circuit cut-off device on the power supply side prior to detaching such a connector from the device for maintenance or the like. However, even if the circuit is cut off in the circuit cut-off device, a terminal fitting of the connector may remain in a charged state by retaining electricity and it is not safe to continue an operation with this overlooked.

Japanese Unexamined Patent Publication No. 2015-82465 discloses a connector housing with a voltage detection opening that can receive a probe of an electroscope to enable easy detection as to whether or not a terminal fitting accommodated in the connector housing is in a charged state. In this connector, a cover unit for the voltage detection opening includes a body plate to be mounted in an area where a voltage detection opening hole is provided, a mounting plate formed to bulge from the body plate in a stepped manner and a sealing plug body made of rubber and to be fit into the voltage detection opening hole of the connector housing by being mounted on the mounting plate. A large-diameter portion is formed above the sealing plug body made of rubber via a constricted part, and the sealing plug is fixed to the mounting plate by fitting that constricted part into a center hole of the mounting plate.

However, the large diameter portion of the sealing plug of Japanese Unexamined Patent Publication No. 2015-82465 to be inserted into the hole of the mounting plate needs to be increased in size if it is attempted to increase a resistance force against the pull of the sealing plug body. However, if the large diameter portion of the sealing plug body is increased in size, the large diameter portion has to be compressed a large amount when being inserted into the hole. Therefore, the ability to attach the sealing plug body is deteriorated.

SUMMARY

This specification relates to a cover unit with a rubber plug, a rubber plug holder to which the rubber plug is attached and a cover. The rubber plug is configured to be pushed into an opening of a device to cover the opening. The cover is to be fixed to the device while being placed on the rubber plug holder. The rubber plug includes a substantially cylindrical rubber plug body to be fit into the opening and a mounting tongue extending from a base part of the rubber plug body via a coupling and having a locking hole. The rubber plug holder includes an insertion hole allowing the mounting tongue of the rubber plug to be inserted on a side opposite to the rubber plug body. The rubber plug holder further includes a hook configured to engage the locking hole of the mounting tongue inserted into the insertion hole and an engaging claw projecting toward the same side as the hook and configured to engage the cover. The mounting tongue of the rubber plug is thicker than the coupling.

The rubber plug is configured such that the mounting tongue having the locking hole is connected integrally to the rubber plug body via the coupling, and the rubber plug is mounted in the rubber plug holder by engaging the hook of the rubber plug with the locking hole. Hooking strength to the hook is enhanced by making the mounting tongue of the rubber plug thicker than the coupling. Thus, the hooking strength of the rubber plug to the hook can be ensured. On the other hand, the coupling of the rubber plug is thinner than the mounting tongue. Accordingly, the coupling can be deformed resiliently with ease. Thus, the coupling can be bent easily when inserting the mounting tongue into the insertion hole of the rubber plug holder to ensure easy attachment of the rubber plug to the rubber plug holder while enhancing the hooking strength of the rubber plug.

A center hole may be provided at a central position of the rubber plug body and may extend in an axial direction of the rubber plug body. Additionally, the rubber plug holder may be provided with a core to be inserted into the center hole. The center hole makes the rubber plug body easily deformable when attaching the rubber plug body to the rubber plug holder, and the coupling easily is deformed resiliently while being accompanied by the resilient deformation of the rubber plug body. Therefore, the mounting tongue is inserted easily into the insertion hole.

In addition, with the rubber plug body completely attached to the rubber plug holder, the core is inserted in the center hole of the rubber plug body. Thus, in that state, the rigidity of the rubber plug body is enhanced and the rubber plug body is attached easily to the opening of the device.

The rubber plug may be provided with two of the mounting tongues at positions symmetrical with respect to an axial center of the rubber plug body, and the rubber plug holder may be provided with two of the hooks and two of the insertion holes at positions symmetrical with respect to the axial center of the rubber plug body. According to this configuration, the mounting tongues are locked at the positions symmetrical with respect to the axial center of the rubber plug body. Thus, the rubber plug is fixed stably to the rubber plug holder.

The connector may include the above-described cover unit with rubber plug, a housing capable of accommodating a terminal fitting connected to an end of a wire, and a voltage detection opening provided on an outer surface of the housing. A tool is insertable into the voltage detection opening for detecting a charged state of the terminal fitting by contacting the terminal fitting. The voltage detection opening may be covered with the cover while the rubber plug body of the cover unit with rubber plug is fit into the voltage detection opening.

According to the cover unit with rubber plug disclosed in this specification, it is possible to ensure the attachability of a rubber plug while ensuring the hooking strength of the rubber plug.

DETAILED DESCRIPTION

An embodiment is described with reference to FIGS. 1 to 23.

A connector C (an example of a "device") of this embodiment is used by being mounted on a casing of an in-vehicle device, such as an inverter installed in a hybrid or electric vehicle. Specifically, a device body is accommodated inside the casing, and the connector C is mounted on an outer surface of this casing. By fitting and connecting the connector C to a mating connector waiting in the casing, power is supplied to the device body in the casing. It should be noted that a connecting direction of the connector C is referred to as a forward direction and a vertical direction is based on FIGS. 1 and 3.

Figure 1:
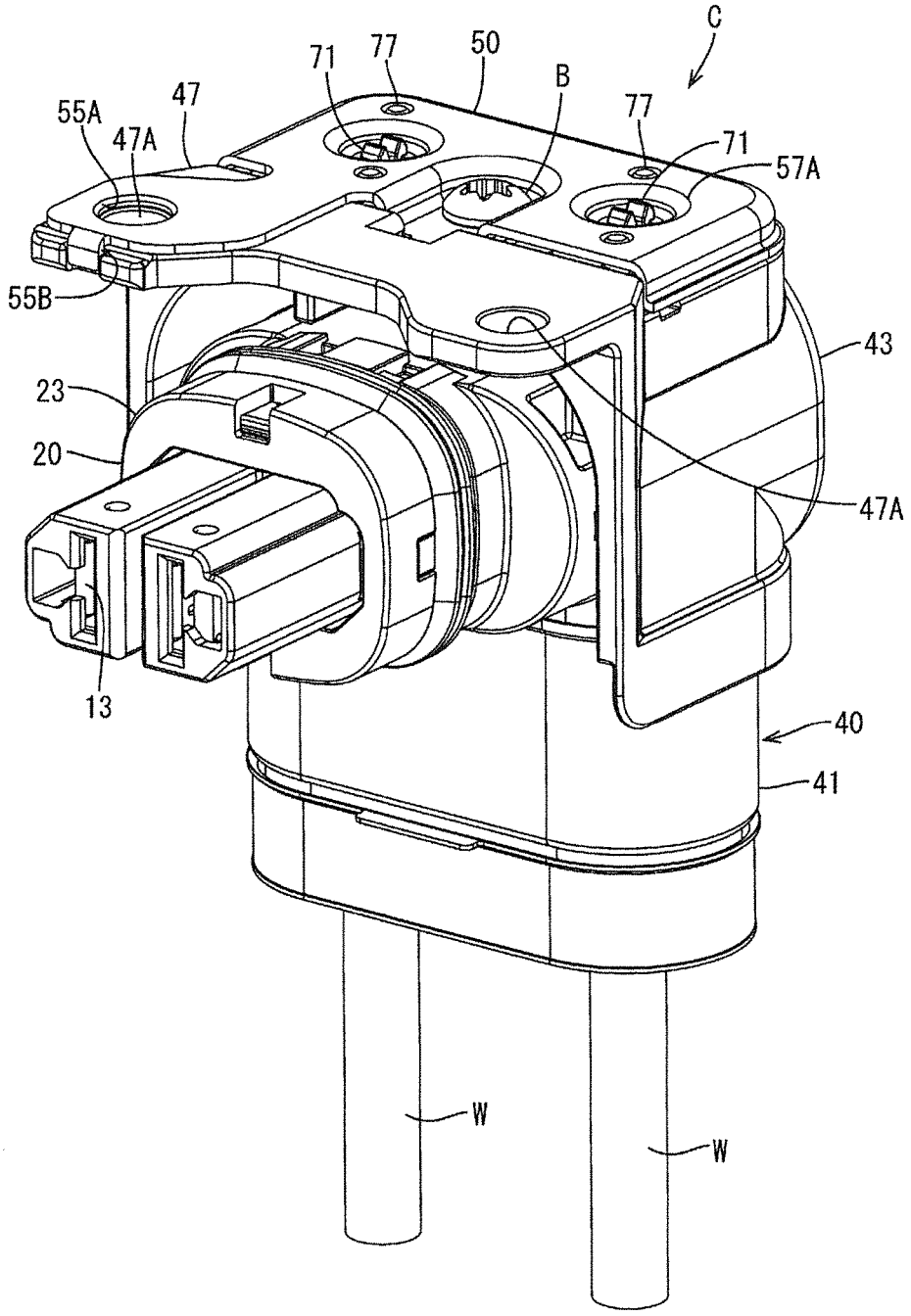
FIG. 1 is a perspective view of a connector according to an embodiment.
Figure 2:
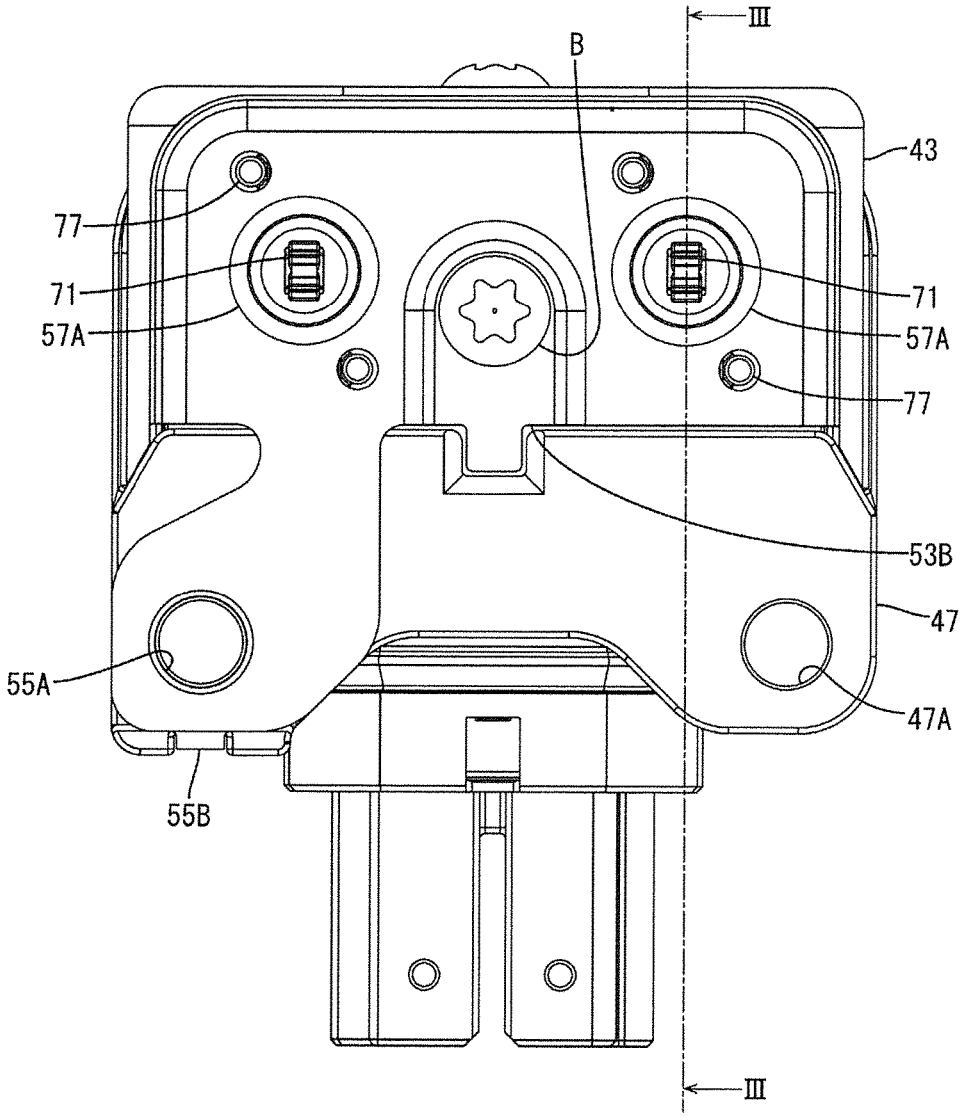
FIG. 2 is a plan view of the connector.
Figure 3:
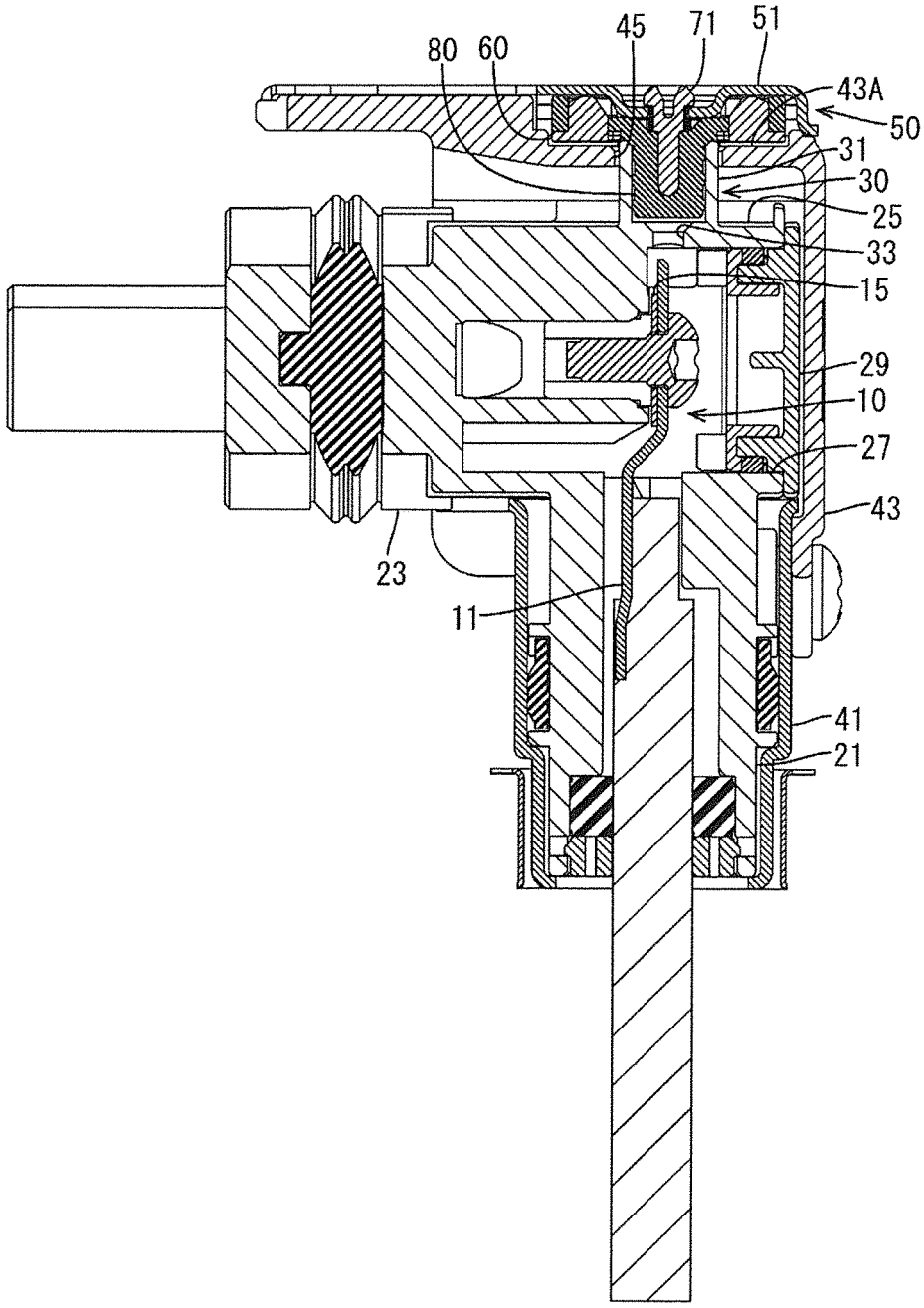
FIG. 3 is a section along III-III of FIG. 2.
Figure 4:
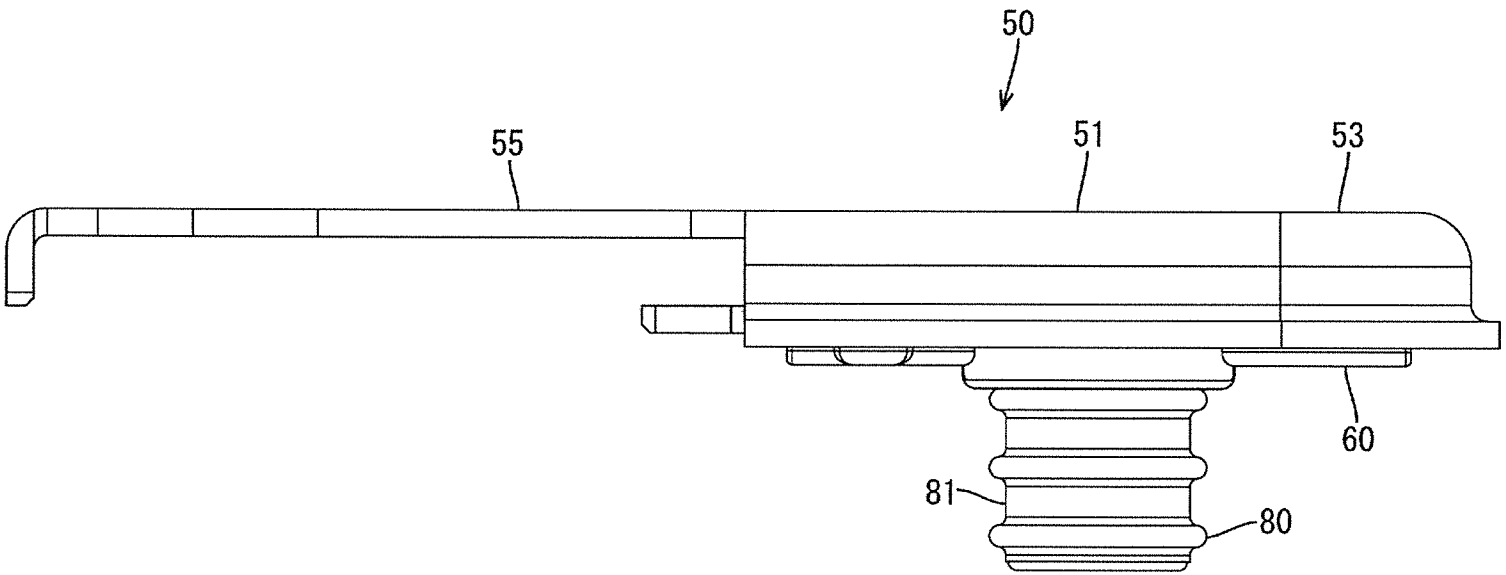
FIG. 4 is a front view of a voltage detection cover.
Figure 5:
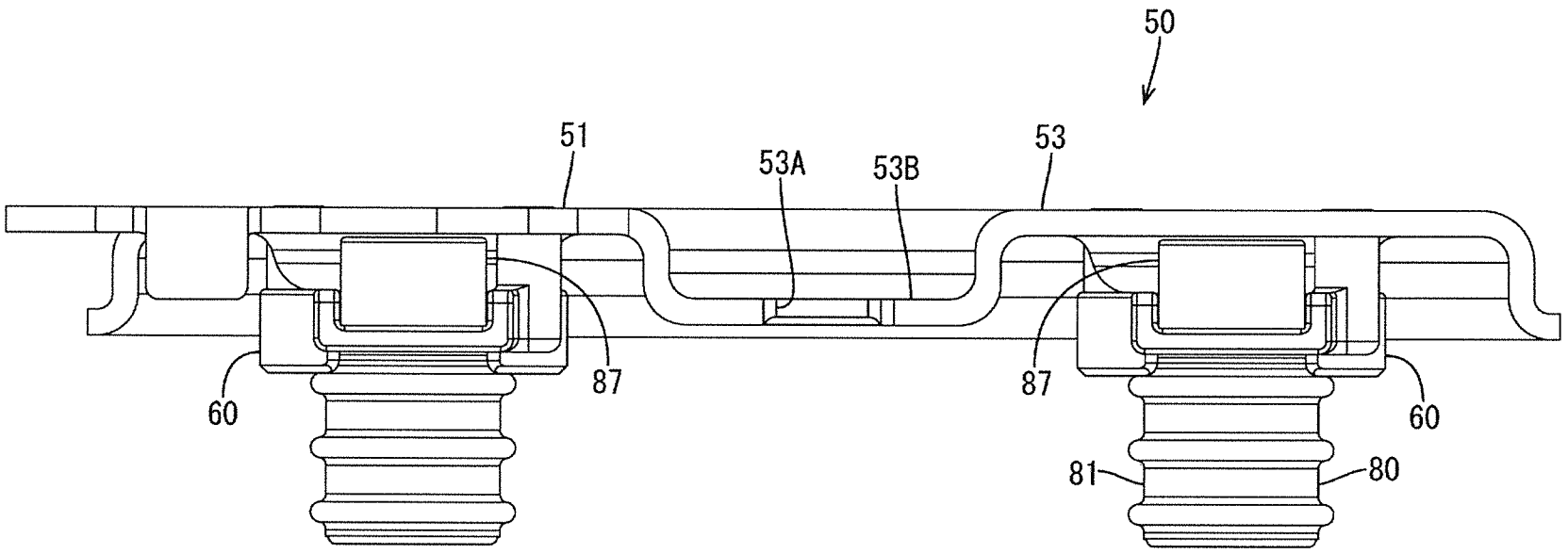
FIG. 5 is a side view of the voltage detection cover.
Figure 6:
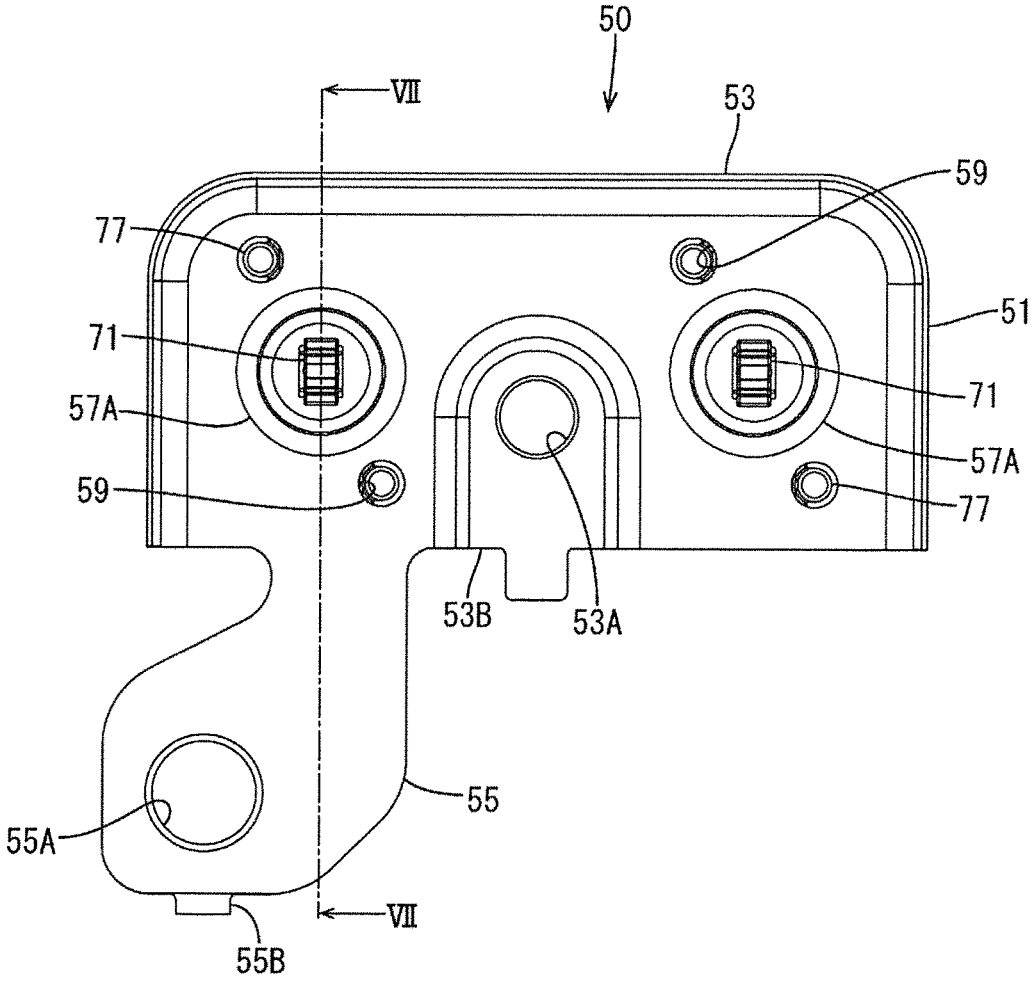
FIG. 6 is a plan view of the voltage detection cover.

As shown in FIGS. 1 to 3, the connector C includes two terminal fittings 10 connected to ends of two wires W pulled out from a DC power supply side, a housing 20 for accommodating these terminal fittings 10, a shield shell 40 to cover the housing 20, and a voltage detection cover 50 (an example of a "cover unit with rubber plug") to be mounted on the upper surfaces of the housing 20 and the shield shell 40.

As shown in FIGS. 1 and 3, each terminal fitting 10 is composed of a wire-side terminal 11 connected to a core of the wire W, a device-side terminal 13 to be fit and connected to a mating terminal accommodated in the mating connector and a connecting member for electrically connecting the device-side terminal 13 and the wire-side terminal 11, and is formed into a substantially L shape.

The housing 20 is made of synthetic resin and includes first and second accommodating portions 21 and 23 and a rearwardly open communicating portion 25 that links the first and second accommodating portions 21 and 23, as shown in FIGS. 1 and 3. The first accommodating portion 21 is formed into an L shape in a side view and has a downward facing portion into which the wire-side terminals 11 of the terminal fittings 10 are accommodated on. The second accommodating portion 23 faces forward and receives parts of the device-side terminals 13 and the connecting members.

Left and right cavities having a circular cross-section vertically penetrate through the first accommodating portion 21. On the other hand, the second accommodating portion 23 has a rectangular cross-section with rounded at corners and is configured to fit tightly to a mounting hole provided in the casing. The second accommodating portion 23 has a stepped tip part reduced in dimensions into a substantially laterally long rectangular shape. Left and right cavities penetrate through the second accommodating portion 23 in a front-rear direction.

As shown in FIG. 3, the communicating portion 25 has a rear opening 27 formed in the rear surface and communicates with rear ends of the cavities of the second accommodating portion 23 and upper ends of the cavities of the first accommodating portion 21. An opening cover 29 made of synthetic resin is attachable to the rear opening 27 in the rear surface of the communicating portion 25. Further, the wire-side terminals 11 are connected to connection terminals 15 of the connecting members by screws in the communicating portion 25.

Left and right voltage detecting portions 30 (an example of an "opening") have cylindrical peripheral walls 31 projecting on the upper surface of the communicating portion 25 at rear positions above and corresponding to the surfaces of the left and right connection terminals 15. Voltage detection holes 331 are open in centers of the bottom surfaces of the respective voltage detecting portions 30 and can receive leads of a tester. Each voltage detection hole 33 is located right above a fastened part of the connection terminal 15 and the wire-side terminal 11.

As shown in FIGS. 1 to 3, the shield shell 40 is composed of a first shield shell 41 for covering the first accommodating portion 21 of the housing 20 and a second shield shell 43 for covering an area of the housing 20 from a rear end part of the second accommodating portion 23 to the communicating portion 25. The first shield shell 41 is formed by working a metal plate of aluminum, aluminum alloy or the like to define a stepped tube having an elliptical outer shape.

The second shield shell 43 also is formed by working a metal plate of aluminum, aluminum alloy or the like as shown in FIGS. 1 to 3. The second shield shell 43 is shaped to cover the upper, rear and both left and right surfaces of the area of the housing 20 from the rear end part of the second accommodating portion 23 to the communicating portion 25 (including the opening cover 29). Thus, the second shield shell 43 has a box shape with open front and rear surfaces. Further, the escaping holes 45 are open at positions of an upper plate 43A of the second shield shell 43 near a rear end to receive the voltage detecting portions 30. The upper plates 43A are recessed slightly down on peripheral edge parts of the escaping holes 45 to accommodate rubber plug holders 60 of the voltage detection cover 50 to be described later.

A mounting plate 47 projects forward while being raised slightly from the upper plate 43A on a front end part of the upper plate 43A of the second shield shell 43, and bolt insertion holes 47A are open in opposite end parts of the mounting hole 47. With the second shield shell 43 properly attached to the housing 20, the mounting plate 47 is placed on the upper surface of the casing and the bolt insertion holes 47A of the mounting plate 47 are aligned with screw holes of the casing when the second accommodating portion 23 of the housing 20 is fit properly into the mounting hole of the casing.

The voltage detection cover 50 is attached detachably to the second shield shell 43 to cover the upper plate 43A. As shown in FIGS. 4 to 7, the voltage detection cover 50 includes a cover 51 made of metal, the rubber plug holders 60 mounted on the cover 51 and rubber plugs 80 to be fixed to the rubber plug holders 60. The cover 51 includes a cover body 53 having substantially the same size as the upper plate 43A of the second shield shell 43 and a cover mounting portion 55 for fixing the cover to the casing together with the shield shell 40.

The cover body 53 is substantially rectangular and is formed into a shallow tray shape with an open front surface by bending a peripheral edge part such that the upper surface of the mounting plate 47 is at the same position as the lower surface of the cover body 53. Further a screw insertion hole 53A is provided substantially at a widthwise central position of the cover body 53 and receives a male screw B (see FIG. 2) for fixing the voltage detection cover 50 and the second shield shell. A peripheral edge part 53B of the screw insertion hole 53A is recessed down relative to the upper surface position of the cover body 53 so as to contact the upper plate 43A of the second shield shell 43.

The cover mounting portion 55 is placed on the mounting plate 47 by partially extending forward from the front end edge of the cover body 53. The cover mounting portion 55 is provided with a bolt insertion hole 55A at a position overlapping the bolt insertion hole 47A of the mounting hole 47. Further, a locking piece 55B is provided on the front end edge of the cover mounting portion 55 and is lockable to an edge of the mounting plate 47.

Figure 8:
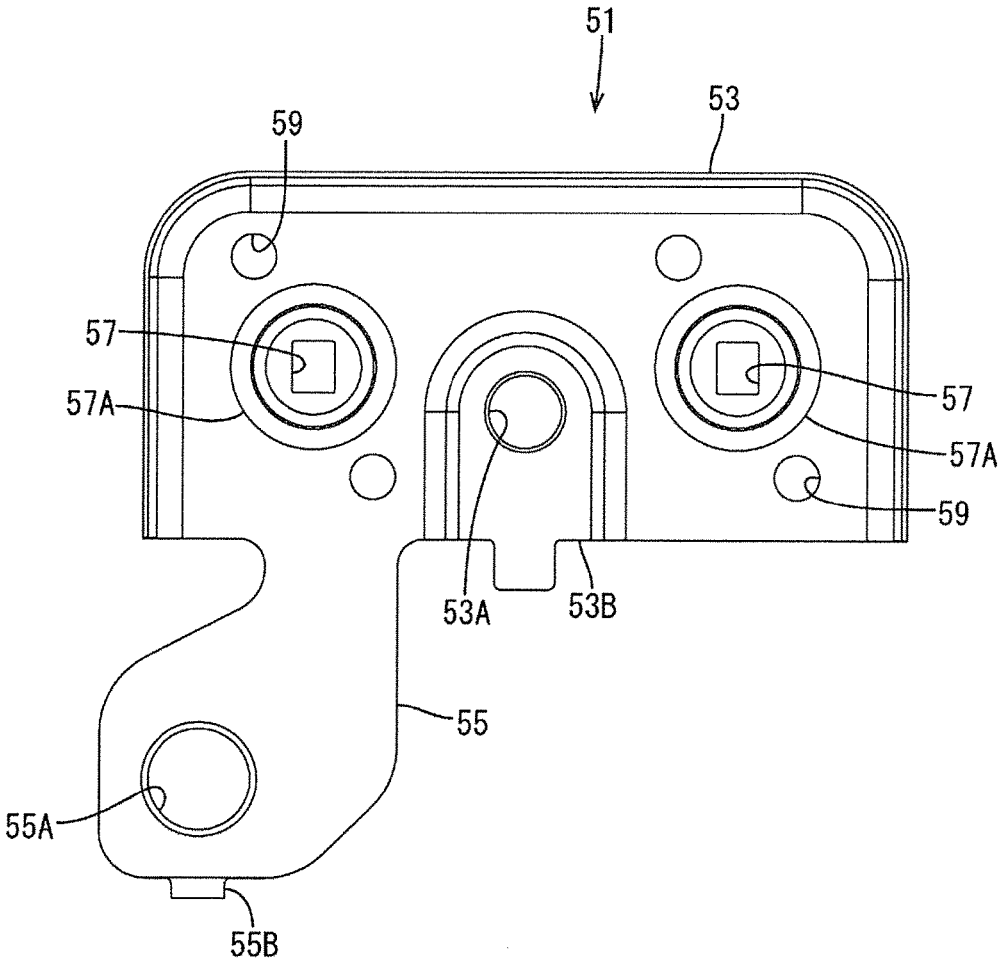
FIG. 8 is a plan view of a cover body.
Figure 9:
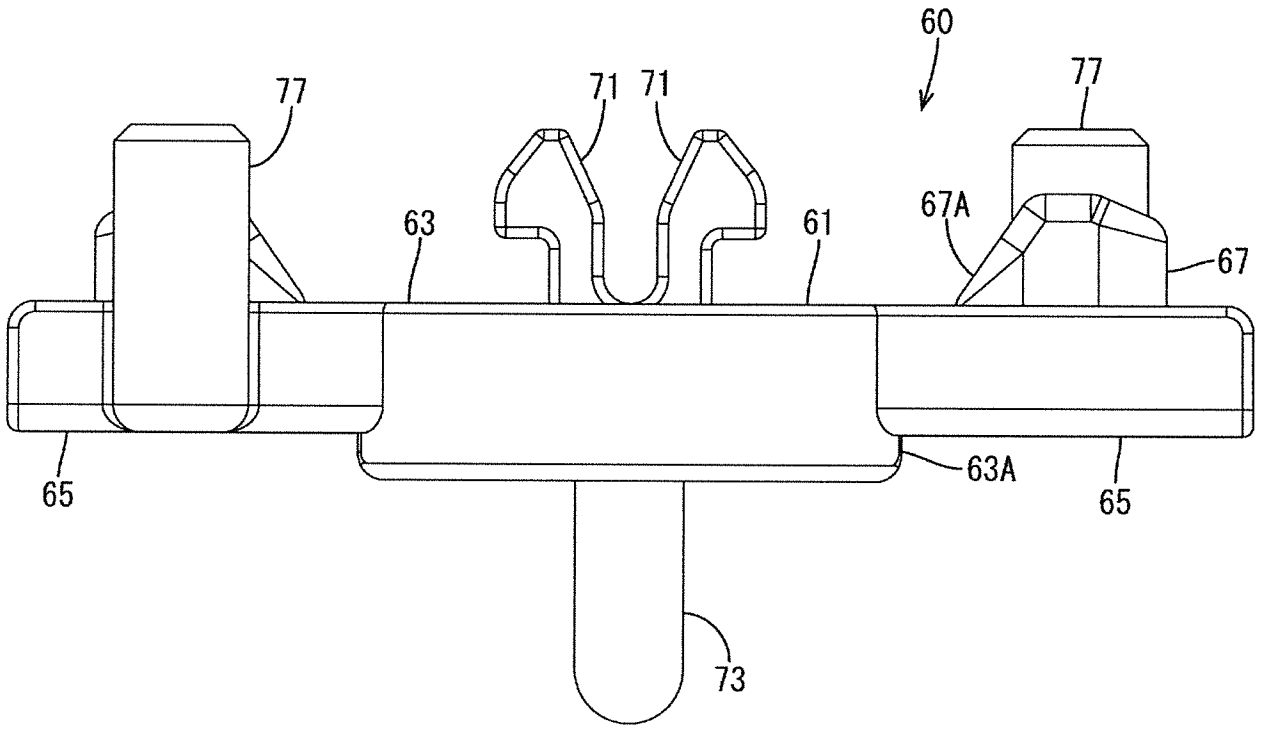
FIG. 9 is a front view of a rubber plug holder.
Figure 10:
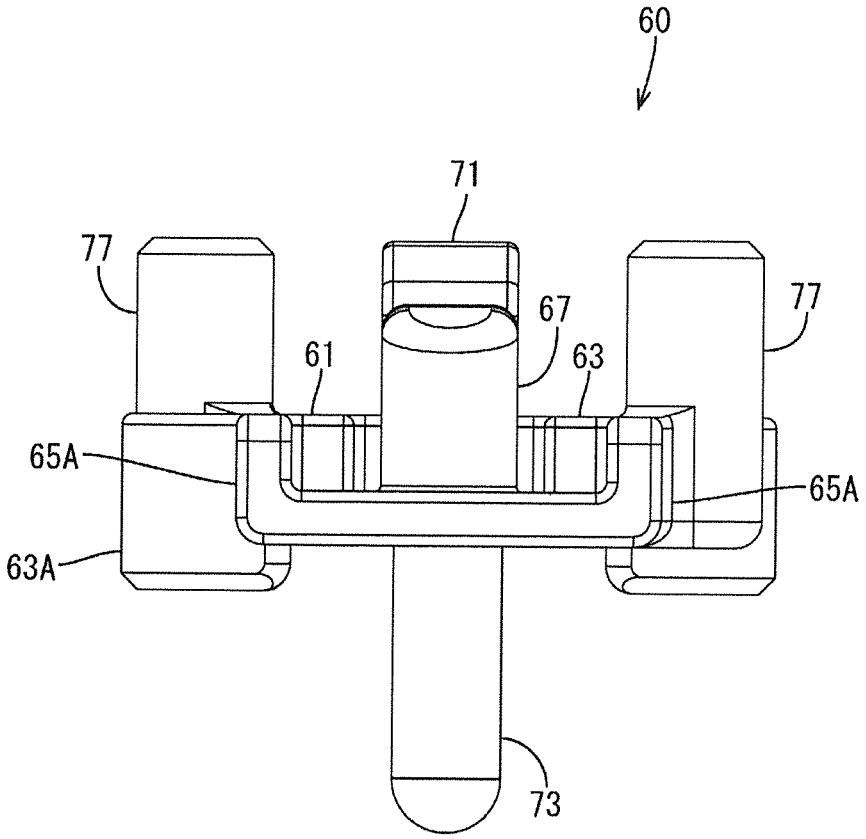
FIG. 10 is a side view of the rubber plug holder.

The cover body 53 is provided with engaging holes 57 respectively at positions above the two voltage detecting portions 30. As shown in FIG. 8, the engaging hole 57 has a substantially rectangular shape and penetrates through the cover body 53 in a plate thickness direction. Further, a peripheral edge part 57A of the engaging hole 57 is recessed down while providing circular steps. Pin insertion holes 59 are provided near the peripheral edge part 57A of the engaging hole 57 and can receive positioning pins 77 to be described later.

The rubber plug holders 60 are mounted on the cover 51. The rubber plug holder 60 is made of synthetic resin and includes, as shown in FIGS. 9 to 12, a holder body 61 in the form of a flat plate, hooks 67 configured to engage locking holes 89 of the rubber plug 80 to be described later, engaging claws 71 configured to engage the engaging hole 57 of the cover body 53, a core 73 projecting down from the holder body 61, insertion holes 75 provided in the holder body 61 and the positioning pins 77.

Figure 11:
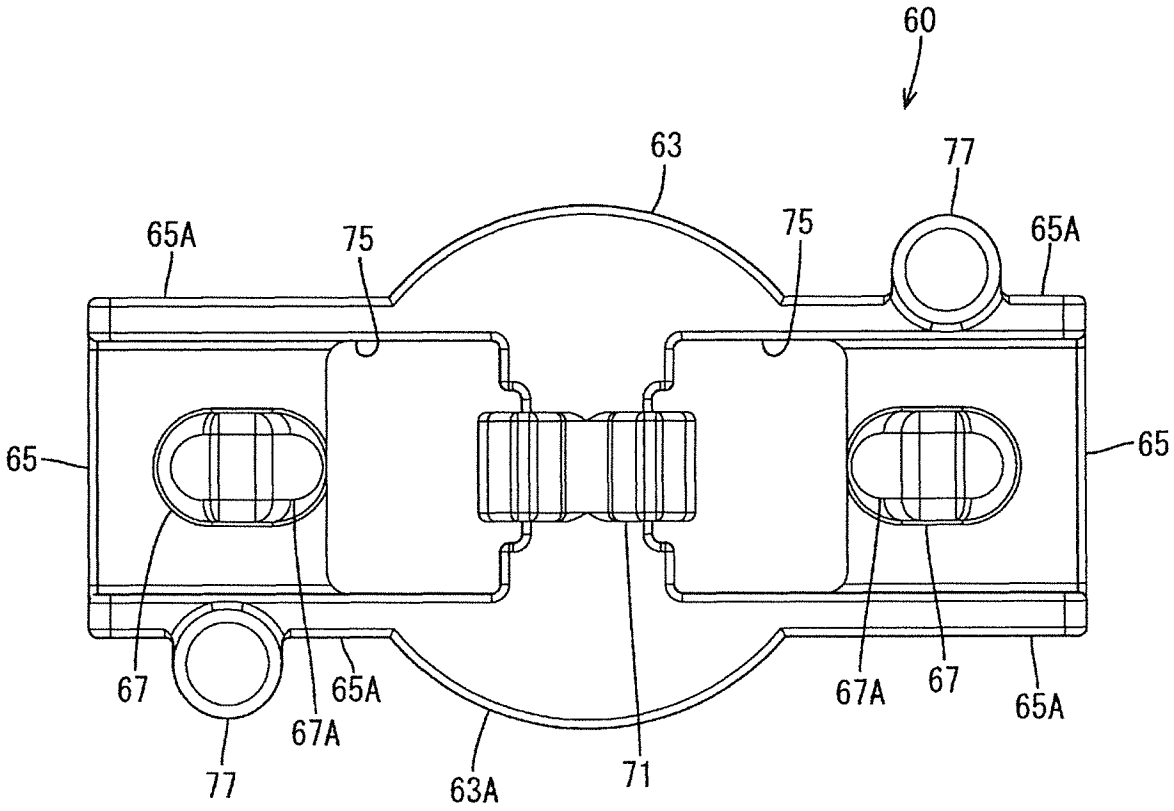
FIG. 11 is a plan view of the rubber plug holder.
Figure 12:
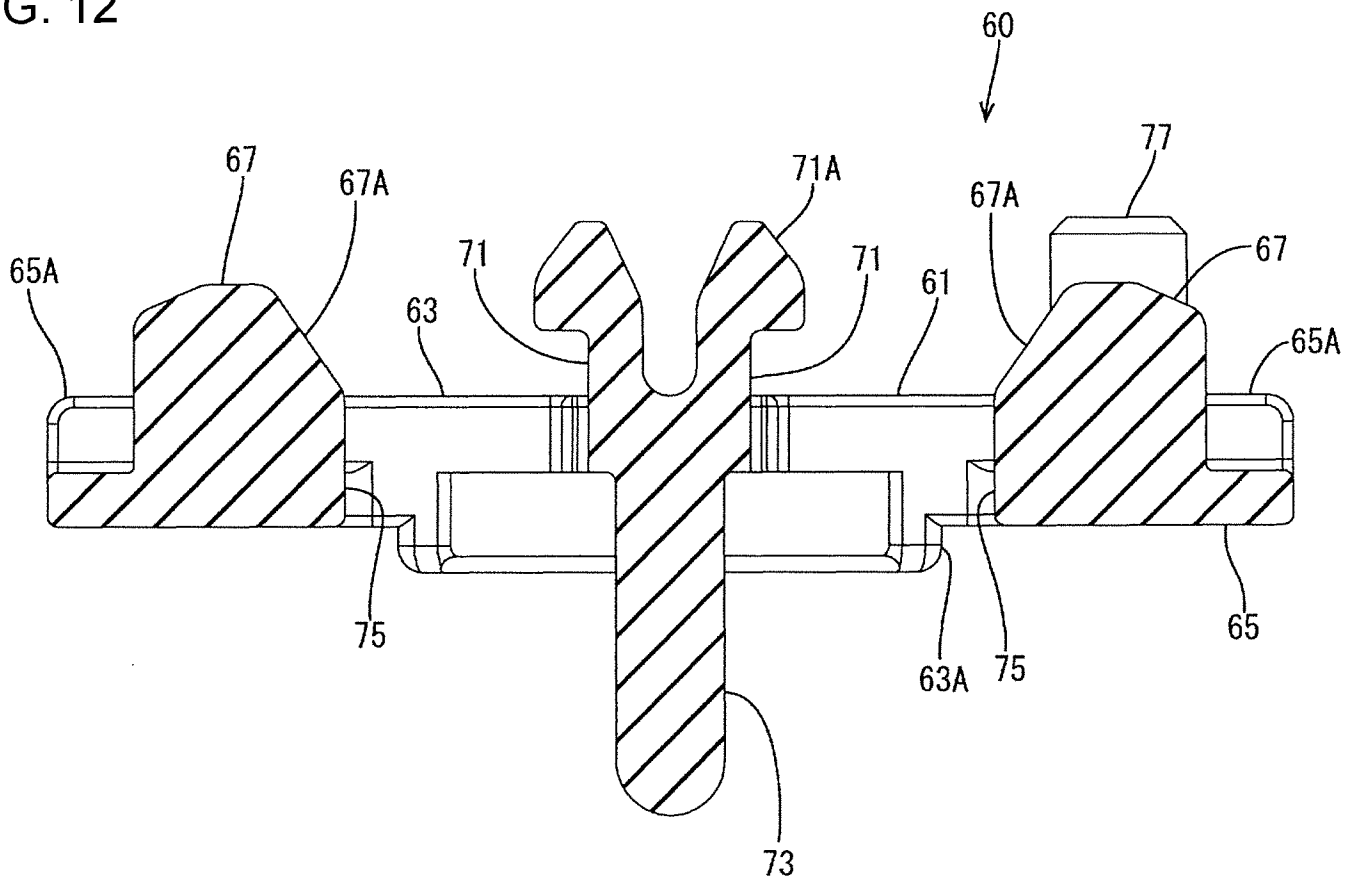
FIG. 12 is a section of the rubber plug holder.

As shown in FIGS. 11 and 12, the holder body 61 includes a substantially circular center portion 63 and substantially rectangular sides 65 disposed on both sides of the center portion 63. An outer peripheral edge part 63A of the center portion 63 is open at the sides 65 while projecting farther down than lower ends of the sides 65. The upper surfaces of the sides 65 are located below that of the center portion 63, and the upper surfaces of both edges 65A thereof are flush with upper surfaces of the center portion 63.

Further, two of the engaging claws 71 projecting up and the core portion 73 projecting down are provided at a substantially central position of the center portion 63 of the holder body 61. The respective engaging claws 71 are resiliently deformable and movable in directions toward and away from each other. Two claws 71 facing in opposite directions are provided respectively on tip parts of the engaging claws 71.

As shown in FIGS. 11 and 12, two of the insertion holes 75 are provided between the side portions 65 and the engaging claws 71 and receive the mounting tongues 87 of the rubber plug 65. Each insertion hole 75 has dimensions larger than a width and a plate thickness of the mounting tongue 87. Further, two of the hooks 67 are provided in central parts of the respective sides 65. Each hook 67 has an inclined surface 67A to be lower on the side of the insertion hole 75. Further, two of the positioning pins 77 are provided laterally to the respective hooks 67 in the respective sides 65. The respective positioning pins 77 are disposed at positions offset from a line connecting the respective hooks 67 and are point-symmetrical with respect to the two engaging claws 71.

Figure 13:
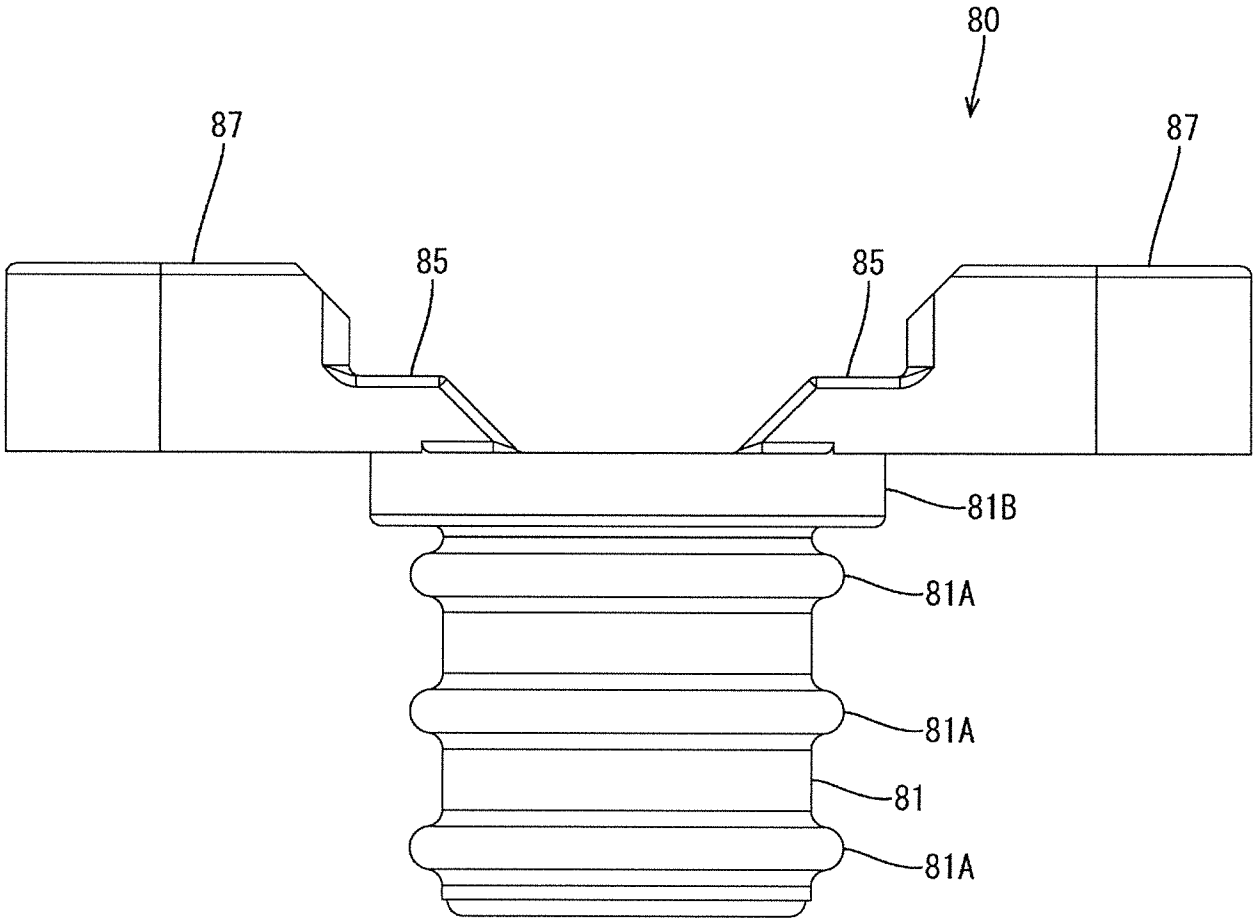
FIG. 13 is a front view of a rubber plug.
Figure 14:
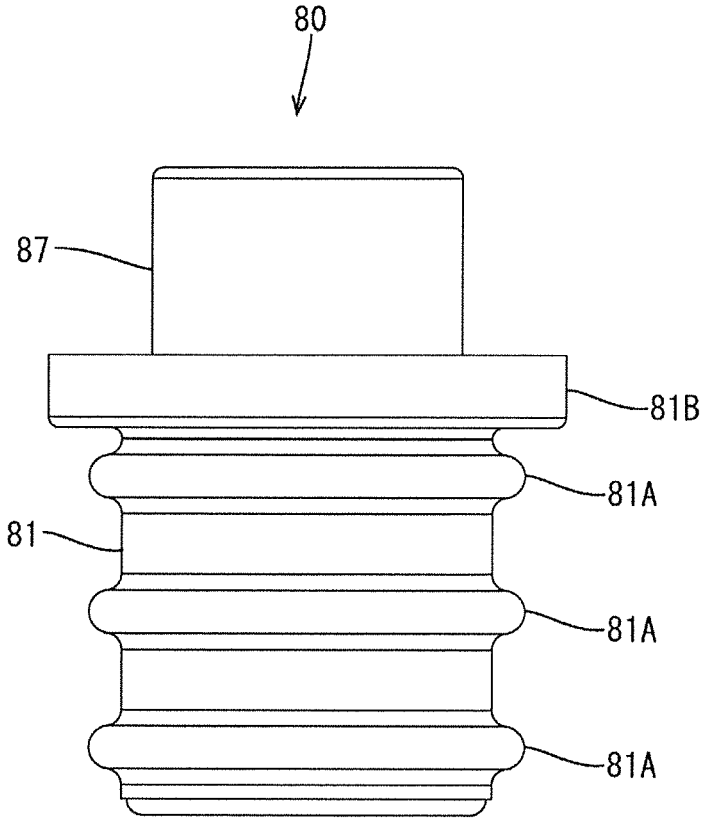
FIG. 14 is a side view of the rubber plug.
Figure 15:
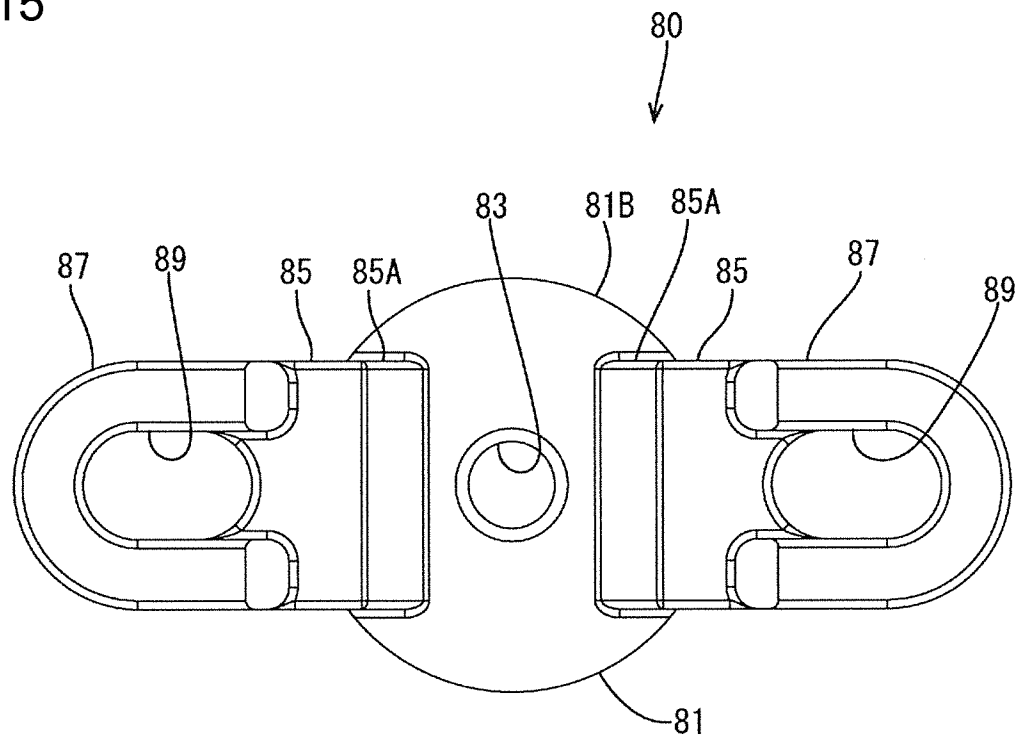
FIG. 15 is a plan view of the rubber plug.
Figure 16:
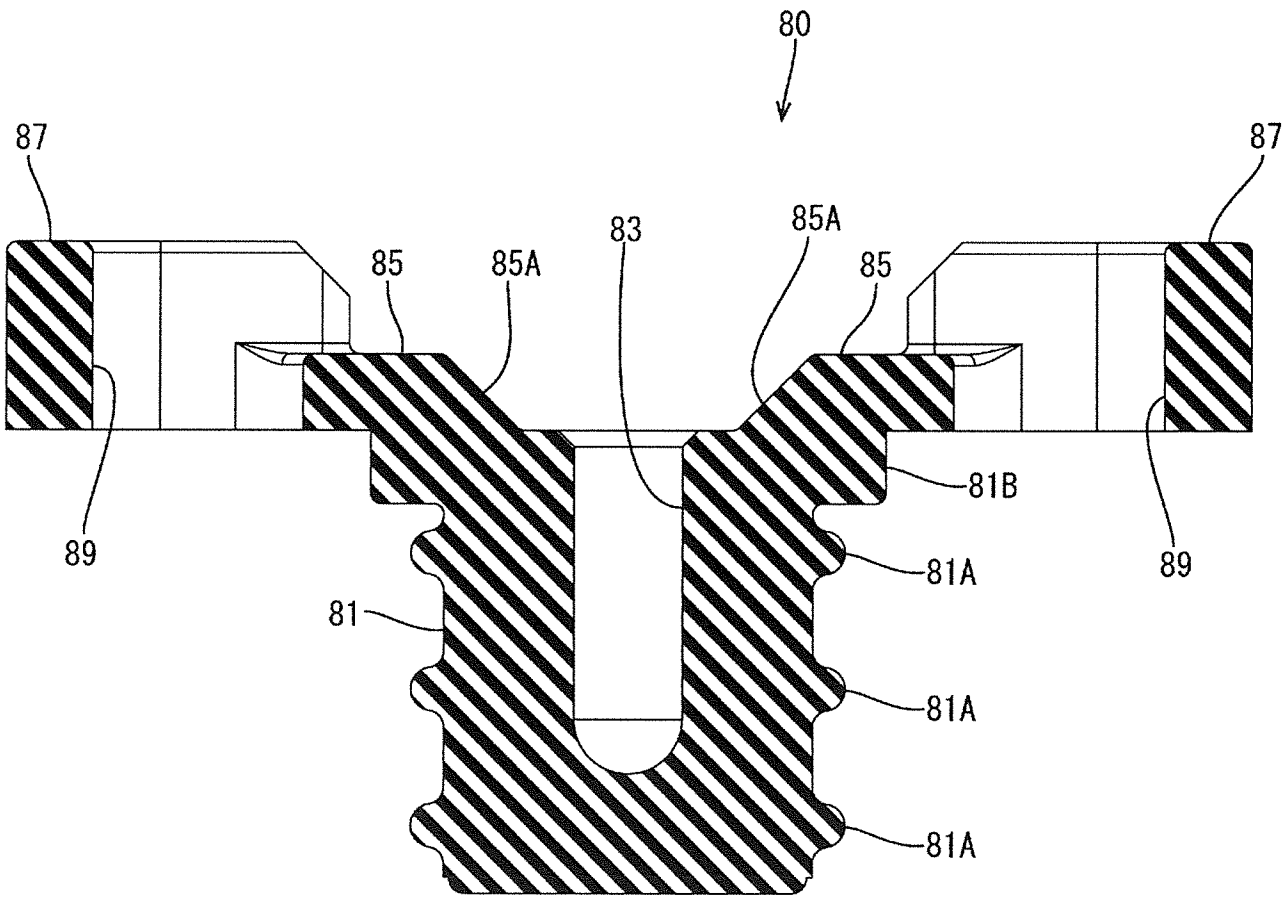
FIG. 16 is a section of the rubber plug.
Figure 17:
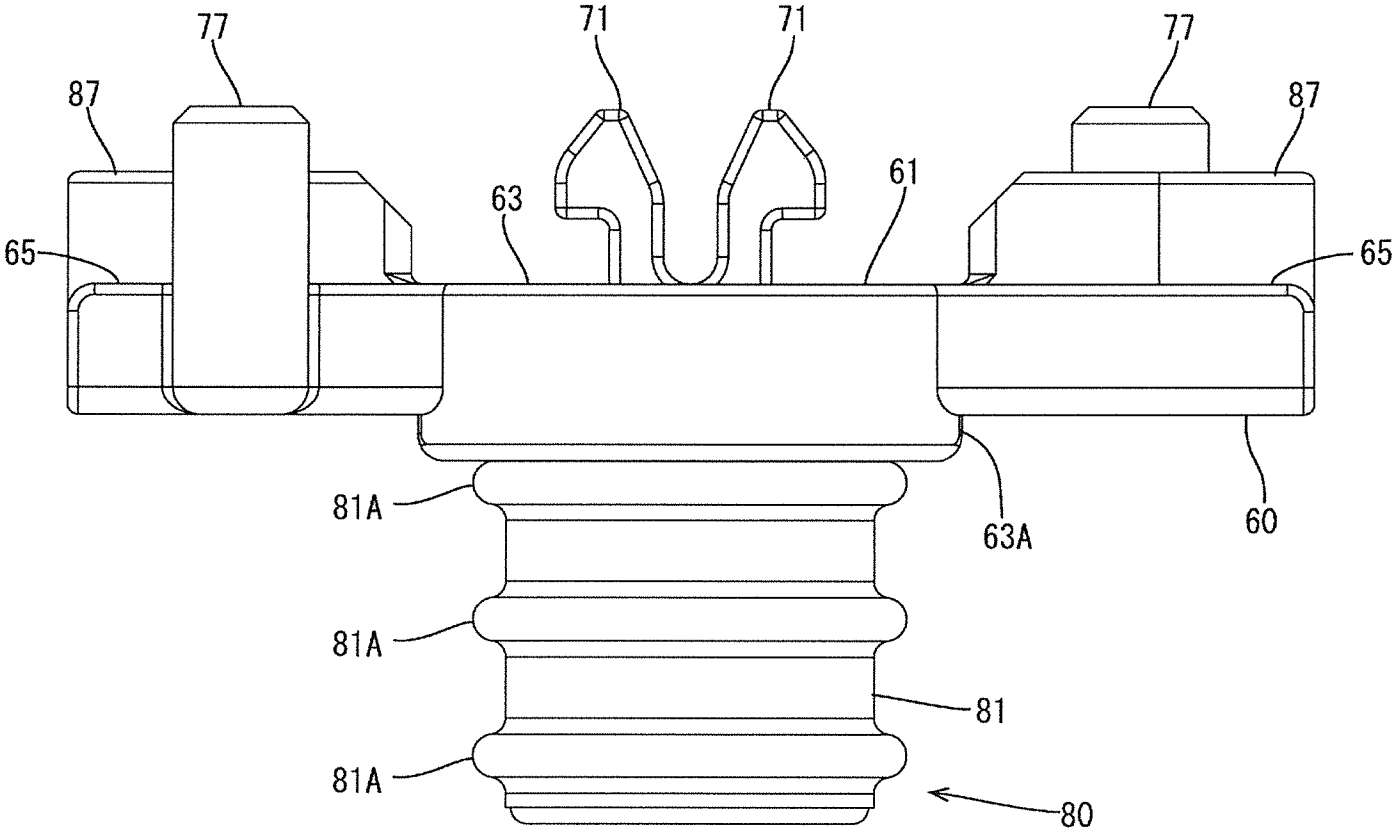
FIG. 17 is a front view of a rubber plug assembled member.
Figure 18:
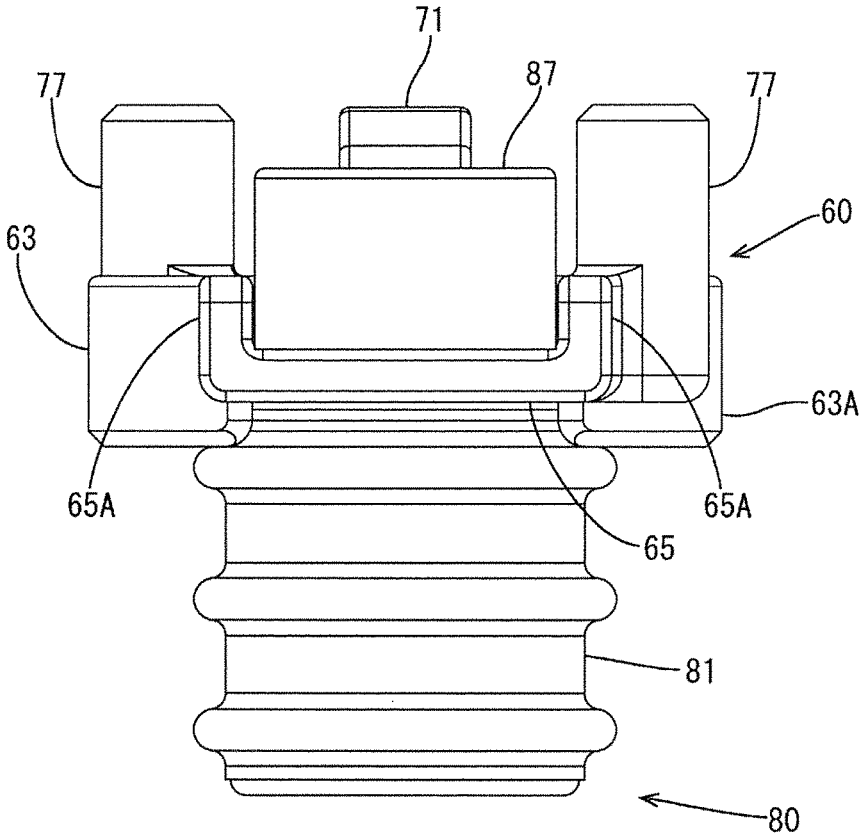
FIG. 18 is a side view of the rubber plug assembled member.
Figure 19:
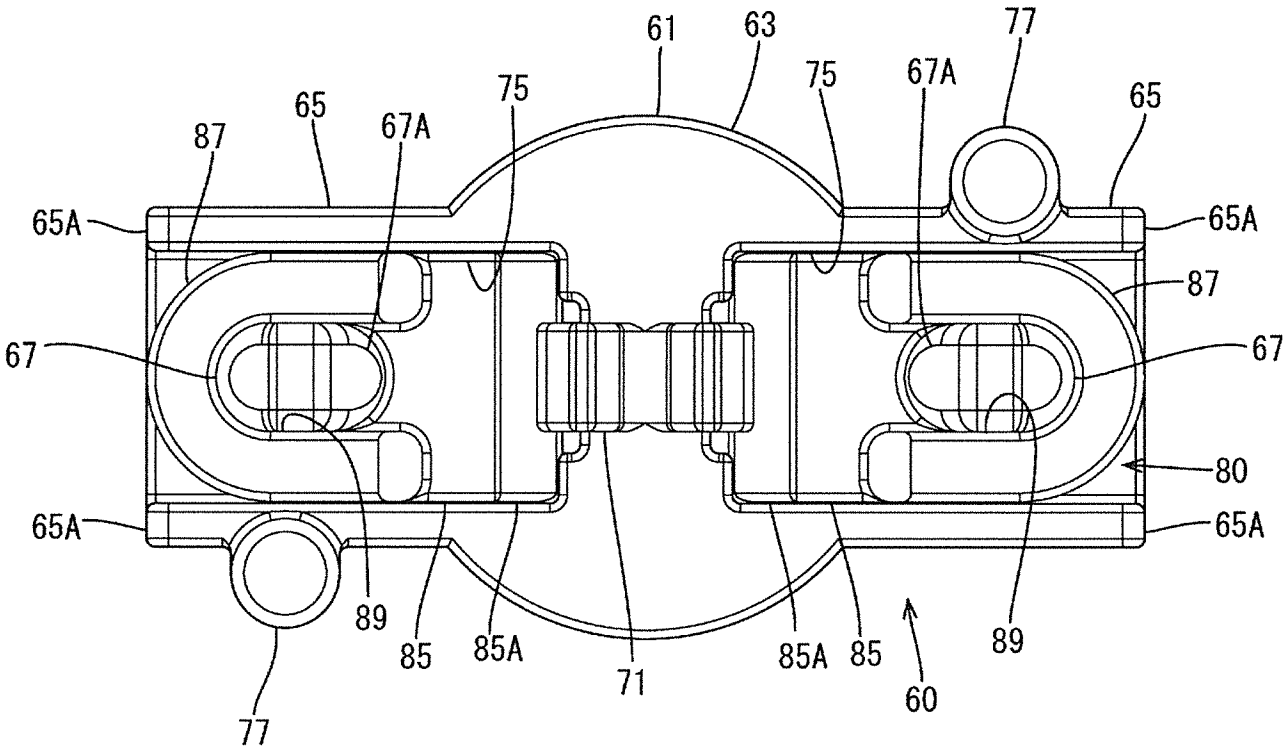
FIG. 19 is a plan view of the rubber plug assembled member.
Figure 20:
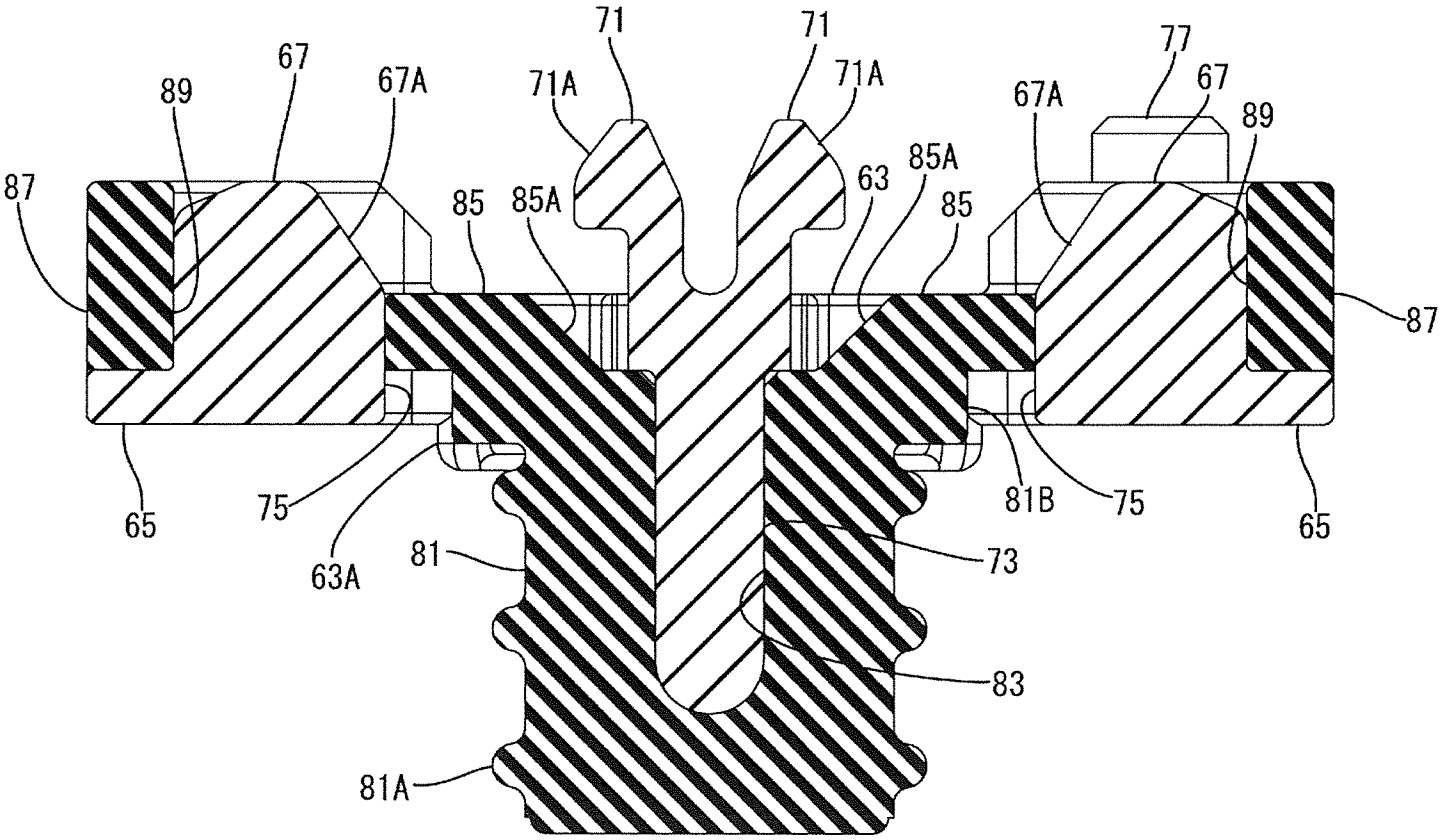
FIG. 20 is a section of the rubber plug assembled member.

As shown in FIGS. 13 to 16, the rubber plug 80 to be attached to the rubber plug holder 60 includes a rubber plug body 81, couplings 85 and the mounting tongues 87. As shown in FIGS. 13 and 16, the rubber plug body 81 has a substantially cylindrical shape and includes lips 81A on the outer peripheral surface thereof. Further, an upper end part of the rubber plug body 81 is a large diameter portion 81B having a larger diameter. A bottomed center hole 83 is open at a substantially central position of an upper surface of the large diameter portion of the rubber plug body 81 and extends in an axial direction of the rubber plug body 81. Note that when the rubber plug 80 is assembled with the rubber plug holder 60, the core 73 is fit into the center hole 83, as shown in FIG. 20. The core 73 is somewhat press-fit into the center hole 83.

As shown in FIG. 15, the mounting tongues 87 extend from a base part (large diameter portion 81B) of the rubber plug body 81 via the couplings 85. Two of the couplings 85 and two of the mounting tongues 87 project radially out of the rubber plug body 81 and are provided at positions symmetrical with respect to an axial center of the rubber plug body 81. Each mounting tongue 87 is provided with an elliptical locking hole 89 long in a radial direction of the rubber plug body 81. By providing the locking hole 89, the mounting tongue 87 is a thick part located radially out of the locking hole 89 and U-shaped in a plan view. A side radially inwardly of the locking hole 89 serves as the coupling 85 connected to the rubber plug body 81 and thinner than the mounting tongue 87. Note that the upper surface of the coupling 85 on the side of the rubber plug body 81 is formed into a tapered surface 85A to thin the coupling 85 toward the bottom.

Figure 21:
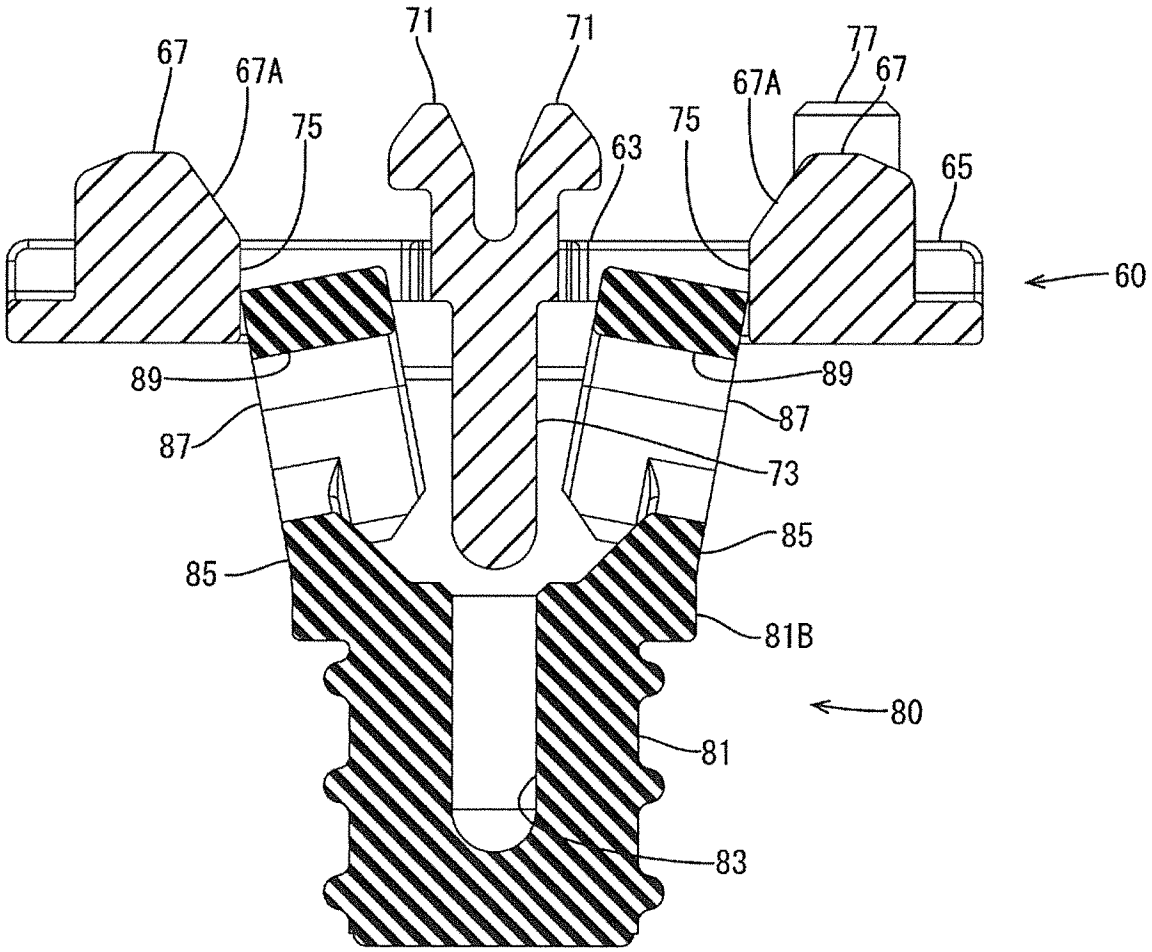
FIG. 21 is a section in a state where the attachment of the rubber plug to the rubber plug holder is started.

To assemble the rubber plug 80 with the rubber plug holder 60, the rubber plug 80 is pinched from both sides by fingers to resiliently deform the respective couplings 85, as shown in FIG. 21. Thus, the couplings 85 and the mounting tongues 87 extend in the axial direction and the respective mounting tongues 87 are inserted into the corresponding insertion holes 75 from below in this posture. At this time, the couplings 85 easily are deformed resiliently due to their thin dimensions. Further, the center hole 83 is provided in the rubber plug body 81. Thus, the rubber plug body 81 is deformed resiliently to be squeezed slightly so that the rubber plug 80 is deformed more easily.

Figure 22:
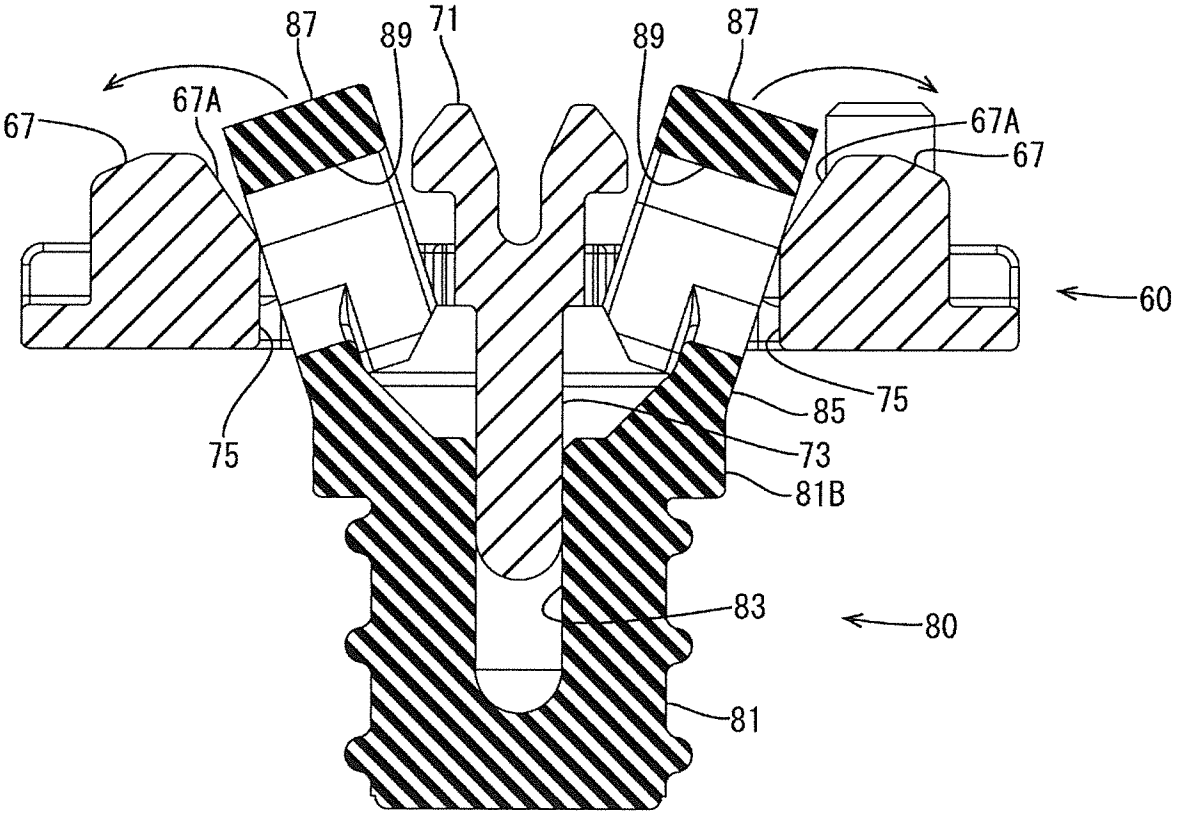
FIG. 22 is a section in a state where locking portions of the rubber plug are passed through insertion holes of the rubber plug holder.

When the mounting tongues 87 reach the inclined surfaces 67A of the hooking protrusions 67, as shown in FIG. 22, the mounting tongues 87 are held in contact with lower end parts of the inclined surfaces 67A. In this state, a part of the core 73 is fit in the center hole 83. The fingers are released from the rubber plug 80 in this state. Thus, the respective mounting tongues 87 move in arrow directions (radially out) of FIG. 8 merely by a reaction force to return to a natural state of the rubber plug 80. In this way, the respective mounting tongues 87 pull up the couplings 85 and the rubber plug body 81 with the lower ends of the inclined surfaces 67A as supports. At this time, the mounting tongues 87 are symmetrical with respect to the axial center of the rubber plug body 81, the rubber plug body 81 can be pulled up from both sides of the mounting tongues 87 and the core 73 is fit easily into the center hole 83.

Figure 23:
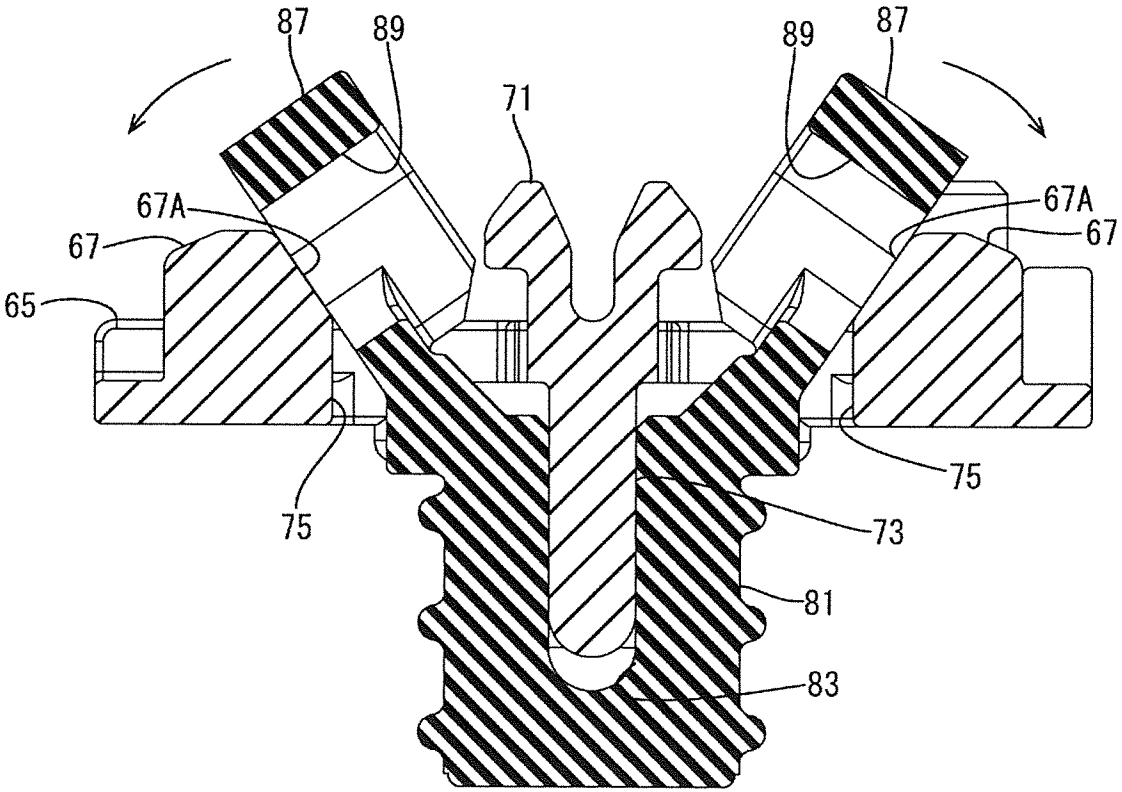
FIG. 23 is a section in a state while the locking portions of the rubber plug are being locked to protrusions of the rubber plug holder.

Then, as shown in FIG. 23, the core 73 is fit farther into the center hole 83 and the mounting tongues 87 move onto the inclined surfaces 67A. The respective mounting tongues 87 continue to pull up the couplings 85 and the rubber plug body 81 with upper end parts of the inclined surfaces 67A as supports by moving in arrow directions of FIG. 23. At this time, since the mounting tongues 87 and the couplings 85 are substantially in an open state, the reaction force of the rubber plug 80 causes the hooking protrusions 67 to fit into the locking holes 89 and the core 73 is fit into the center hole 83 as a reflex action.

Subsequently, the tips of the mounting tongues 87 pass through the hooking protrusions 67, and the couplings 85 smoothly return without being obstructed. At the same time that the core 73 is fit properly into the center hole 83, as shown in FIG. 20, the hooks 67 are fit into the locking holes 89 of the mounting tongues 87 from below. As just described, it is not necessary to push the hooks 67 into the locking holes 89 by pulling the mounting tongues 87 with fingers or deforming the mounting tongues 87 until the assembling of the rubber plug 80 is completed after the fingers are released from the rubber plug 80, and a series of operations are performed automatically merely by the reaction force of the rubber plug 80.

The rigidity of the rubber plug body 81 is enhanced by the core 73 that has been fit properly into the center hole 83 and sealing for the voltage detecting portions 30 also is enhanced. Further, the large diameter portion 81B is accommodated into the inside of the outer peripheral edge part 63A of the center portion 63 and the couplings 85 are accommodated into the insertion holes 75. Thus, the rubber plug 80 is less likely to be detached from the rubber plug holder 60 due to deformation or the like even if the rubber plug 80 is pulled. Furthermore, the respective hooks 67 are engaged with the respective locking holes 89 at the positions symmetrical with respect to the axial center of the rubber plug body 81 and the upper ends of the respective hooks 67 and those of the respective mounting tongues 87 are disposed at the same height. In this way, the rubber plug 80 is positioned stably with respect to the rubber plug holder 60 and, even if the rubber plug body 81 is pulled down, the mounting tongues 87 have sufficient strength against the pull. Thus, the rubber plug 80 is held in the rubber plug holder 60 while being retained by locking between the mounting tongues 87 and the hooks 67.

Figure 7:
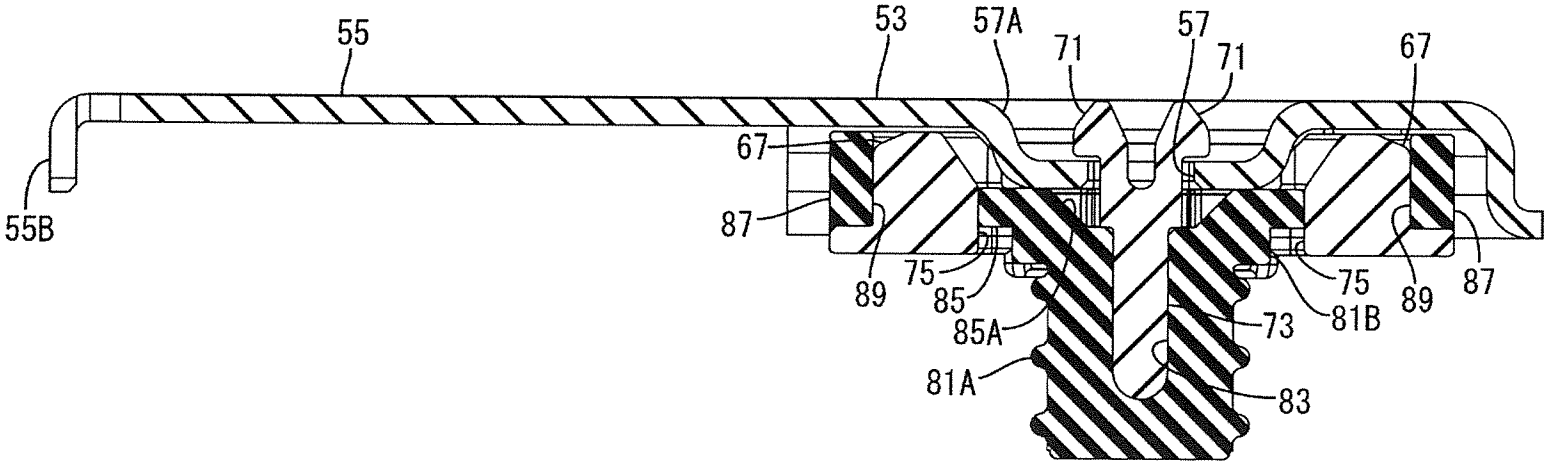
FIG. 7 is a section along VII-VII of FIG. 6.

When the rubber plugs 80 are assembled with the rubber plug holders 60 in this way and these assemblies are assembled with the cover 51, the pairs of engaging claws 71 are fit into the engaging holes 57 and locked to hole edge parts of the engaging holes 57, as shown in FIG. 7. Thus, the rubber plug holders 60 are fixed to the cover 51, thereby constituting the voltage detection cover 50. The peripheral edge parts 57A of the cover body 63 where the engaging holes 57 are formed are recessed. Thus, the upper ends of the pairs of the engaging claws 71 fit into the engaging holes 57 and the upper surface of the cover body 53 are disposed substantially at the same height. Further, the couplings 85 of the rubber plugs 80 are in contact with the peripheral edges 57A of the engaging holes 57.

When the voltage detection cover 50 assembled in this way is attached to the connector C to cover the voltage detecting portions 30, the rubber plug bodies 81 are fit water-tightly to the inner surfaces of the peripheral walls 31 while the lips 81A of the rubber plug bodies 81 are squeezed, as shown in FIG. 3. Then, as shown in FIG. 1, the voltage detection cover 50 is fixed to the second shield shell 43 by the male screw B. Further, as shown in FIG. 1, each positioning pin 77 is inserted through each pin insertion hole 59. Thus, even if the cover 51 is inclined when the voltage detection cover 50 is detached from the second shield shell 43, each positioning pin 77 interferes with the peripheral wall of each pin insertion hole 59, thereby drastically suppressing the inclination of the cover 51.

As described above, in this embodiment, hooking strength to the hooks 67 is enhanced by making the mounting tongues 87 of the rubber plug 80 thicker than the couplings 85. Thus, the hooking strength of the rubber plug 80 to the rubber plug holder 60 is ensured. On the other hand, since the couplings 85 of the rubber plug 80 are thinner than the mounting tongues 87, the couplings 85 easily deform resiliently. When the mounting tongues 87 are inserted into the insertion holes 75 of the rubber plug holder 60, the couplings 85 can be bent easily and the rubber plug 80 can be attached easily to the rubber plug holder 60.

The center hole 83 extends in the axial direction at the central position of the rubber plug body 81, and the rubber plug holder 60 is provided with the core 73 to be inserted into the center hole 83. Thus, before the rubber plug body 81 is attached to the rubber plug holder 60, the rubber plug body 81 is hollow by having the center hole 83. Thus, the rubber plug body portion 81 is easily deformable. Specifically, in resiliently deforming the couplings 85 to attach the rubber plug 80 to the rubber plug holder 60, the couplings 85 easily are deformed resiliently while resiliently deforming the rubber plug body 81. Therefore, the mounting tongues 87 are inserted easily into the insertion holes 75.

In addition, with the rubber plug body 81 completely attached to the rubber plug holder 60, the core 73 is inserted in the center hole 83 of the rubber plug body 81. Thus, in that state, the rigidity of the rubber plug body 81 is enhanced and the rubber plug body 81 is attached easily to the voltage detecting portion 30.

Furthermore, the rubber plug 80 is provided with the two mounting tongues 87 at the positions symmetrical with respect to the axial center of the rubber plug body 81, and the rubber plug holder 60 is provided with the two hooks 67 and the two insertion holes 75 at the positions symmetrical with respect to the axial center of the rubber plug body 81. Thus, the mounting tongues 87 are locked at the positions symmetrical with respect to the axial center of the rubber plug body 81, and the rubber plug 80 is fixed stably to the rubber plug holder 60.

This specification is not limited to the above described and illustrated embodiment. For example, the following embodiments are also included in scope of the invention.

The voltage detection cover 50 is attached to the voltage detecting portions 30 provided in the connector C in the above embodiment. However, a cover may be mounted on an opening of a device such as an inverter instead of the connector.

The two mounting tongues 87, the two couplings 85, the two insertion holes 75 and the two hooks 67 are provided at the positions symmetrical with respect to the axial center of the rubber plug body 81 in the above embodiment. However, only one of each component may be provided, or three or more of each component may be provided at equal intervals. Further, the components may be provided at uneven intervals.

Although the two engaging claws 71 are provided at the central position of the center portion 63 in the above embodiment, the engaging claws 71 may be provided at another position.

Although the center hole 83 is provided in the rubber plug body 81 and the core 73 is inserted therein in the above embodiment, the center hole 83 and the core 73 may be omitted.

LIST OF REFERENCE SIGNS

20 . . . housing
30 . . . voltage detecting portion (voltage detection opening)
40 . . . shield shell
43 . . . second shield shell
50 . . . voltage detection cover (cover unit with rubber plug)
51 . . . cover
53 . . . cover body
57 . . . engaging hole
57A . . . peripheral edge
59 . . . pin insertion hole
60 . . . rubber plug holder
61 . . . holder body
67 . . . hook
67A . . . inclined surface
71 . . . engaging claw
73 . . . core
75 . . . insertion hole
77 . . . positioning pin
80 . . . rubber plug
81 . . . rubber plug body
83 . . . center hole
85 . . . coupling
87 . . . mounting tongue piece
89 . . . locking hole
C . . . connector (device)

The invention claimed is:

1. A cover unit, comprising a rubber plug to be pushed into an opening of a device to cover the opening, a rubber plug holder configured such that the rubber plug is attached thereto, and a cover to be fixed to the device while being placed on the rubber plug holder, wherein:

the rubber plug includes a substantially cylindrical rubber plug body to be fit into the opening and a mounting tongue extending from a base part of the rubber plug body via a coupling and having a locking hole;

the rubber plug holder includes an insertion hole allowing the mounting tongue of the rubber plug to be inserted on a side opposite to the rubber plug body, a hook configured to engage the locking hole of the mounting tongue inserted into the insertion hole, and an engaging claw projecting toward the same side as the hook and configured to engage the cover; and the mounting tongue of the rubber plug is thicker than the coupling.

2. The cover unit of claim 1, wherein:

a center hole extending in an axial direction of the rubber plug body is provided at a central position of the rubber plug body; and the rubber plug holder is provided with a core to be inserted into the center hole.

3. The cover unit of claim 2, wherein:

the rubber plug is provided with two of the mounting tongues at positions symmetrical with respect to an axial center of the rubber plug body; and the rubber plug holder is provided with two of the hooks and two of the insertion holes at positions symmetrical with respect to the axial center of the rubber plug body.

4. A connector, comprising:

the cover unit of claim 3;

a housing capable of accommodating a terminal fitting connected to an end of a wire; and a voltage detection opening provided on an outer surface of the housing, a tool for detecting a charged state of the terminal fitting by contacting the terminal fitting being insertable into the voltage detection opening, the voltage detection opening being covered with the cover while the rubber plug body of the cover unit with rubber plug is fit into the voltage detection opening.

5. The cover unit of claim 1, wherein:

the rubber plug is provided with two of the mounting tongues at positions symmetrical with respect to an axial center of the rubber plug body; and the rubber plug holder is provided with two of the hooks and two of the insertion holes at positions symmetrical with respect to the axial center of the rubber plug body.

6. A connector, comprising:

the cover unit of claim 1;

a housing capable of accommodating a terminal fitting connected to an end of a wire; and a voltage detection opening provided on an outer surface of the housing, a tool for detecting a charged state of the terminal fitting by contacting the terminal fitting being insertable into the voltage detection opening, the voltage detection opening being covered with the cover while the rubber plug body of the cover unit with rubber plug is fit into the voltage detection opening.

* * * * *